US007457533B2

(12) United States Patent
Hess et al.

(10) Patent No.: US 7,457,533 B2
(45) Date of Patent: Nov. 25, 2008

(54) ELECTRIC HEATING DEVICE

(75) Inventors: Kristoffer Hess, Cambridge (CA); Kelly Stinson, Kitchener (CA)

(73) Assignee: Dimplex North America Limited, Cambridge, ON (CA)

( * ) Notice: Subject to any disclaimer, the term of this patent is extended or adjusted under 35 U.S.C. 154(b) by 0 days.

(21) Appl. No.: 11/750,442

(22) Filed: May 18, 2007

(65) Prior Publication Data

US 2007/0280650 A1 Dec. 6, 2007

Related U.S. Application Data

(60) Provisional application No. 60/801,044, filed on May 18, 2006.

(51) Int. Cl.
*F24H 3/02* (2006.01)
*F24H 3/06* (2006.01)

(52) U.S. Cl. ..... 392/356; 392/360

(58) Field of Classification Search ..... 392/311–321, 392/347–369; 219/482–492
See application file for complete search history.

(56) References Cited

U.S. PATENT DOCUMENTS 3,737,622 A 6/1973 Hallgreen
4,302,663 A * 11/1981 Chesnut et al. ..... 219/497
4,316,077 A 2/1982 Carlson
4,642,441 A * 2/1987 Kenyon ..... 392/365
5,187,349 A * 2/1993 Curhan et al. ..... 219/202
5,197,112 A 3/1993 Cameron
6,760,543 B1 7/2004 Orr et al.
6,973,260 B2 12/2004 Orr et al.
6,897,416 B2 5/2005 Bohlender et al.

OTHER PUBLICATIONS

Product Sheet, PTC Finned Resistor Heating Element, Type B34-96-3, Backer BHV AB, Sweden.

* cited by examiner

*Primary Examiner*—Sang Y Paik

(57) ABSTRACT

An electric heating device including a fan for moving a volume of air at a rate substantially corresponding to a speed of rotation of the fan, and a fan motor for rotating the fan over a range of speeds. The device also has a heat generator with one or more PTC elements for generating heat, and for transferring the heat to the moving volume of air. In addition, the device has a control subassembly adapted for proportionate control of the fan motor based on a variable required heat output so that the rate of movement of the moving volume of air varies in proportion to changes in the required heat output.

18 Claims, 6 Drawing Sheets

ELECTRIC HEATING DEVICE

This application claims the benefit of U.S. Provisional Application No. 60/801,044, filed May 18, 2006.

FIELD OF THE INVENTION

This invention is related to electric heating devices.

BACKGROUND OF THE INVENTION

Various types of electric air heating devices using PTC ("positive temperature coefficient") elements are known. A PTC element has a given resistivity at any given temperature, and the resistivity of the PTC element rises or falls with its temperature. In particular, the PTC element's resistivity rises exponentially once its temperature is increased over a certain temperature. Accordingly, once the PTC element's temperature is high enough, the resistivity of the PTC element becomes sufficiently high that the flow of current therethrough is nearly stopped. Because of this property, PTC elements have the beneficial characteristic of being self-limiting, thereby reducing the risk that an electric heater which includes a PTC element may cause a fire. However, in the prior art, PTC elements have been used primarily as sensors, to severely limit current when necessary for safety.

In addition, a heater with a heating element including one or more PTC elements which produces a specified output for a specified airflow is known. However, this prior art device does not provide for proportionate (i.e., variable) control of the heating element. Instead, this device produces a preselected power output for a preselected airflow when activated, i.e., the control is fixed because the heater can only be activated or de-activated, and if activated, only a certain output is provided thereby. Repeatedly turning this prior art heater on and off in response to signals from a thermostat tends to create significant changes in the ambient temperature, i.e., the typical thermostat does not signal for more heat until room temperature is relatively far below the setpoint temperature. Also, the typical thermostat does not stop a heater from operating until the setpoint temperature is exceeded, generally to an extent which is noticeable by those in the room.

There is therefore a need for an electric heating device which overcomes or mitigates one or more of the defects of the prior art.

SUMMARY OF THE INVENTION

In its broad aspect, the invention provides an electric heating device including a fan for moving a volume of air at a rate substantially corresponding to a speed of rotation of the fan and a fan motor for rotating the fan over a range of speeds. The device also includes a heat generator with one or more PTC elements for generating heat, and for transferring the heat to the moving volume of air. Also, the device has a control subassembly adapted for proportionate control of the fan motor based on a variable required heat output so that the rate of movement of the moving volume of air varies in proportion to changes in the required heat output.

In another of its aspects, the invention provides a method of heating air having an ambient temperature. The method includes, first, providing a fan for moving a volume of air at a rate substantially corresponding to a speed of rotation of the fan, and subsequently, providing an electric fan motor for rotating the fan over a range of speeds. Next, a heat generator is provided which includes one or more PTC elements for generating heat, and for transferring the heat to the moving volume of air. Finally, a control subassembly is provided which is adapted for proportionate control of the motor based on a variable required heat output so that the rate of movement of the volume of air varies in proportion to changes in the required heat output.

In yet another aspect, the invention provides an electric heating device including a fan for moving a volume of air at a rate substantially corresponding to a speed of rotation of the fan, and an electric fan motor for rotating the fan over a range of speeds. The device also includes a heat generator having one or more PTC elements for generating heat and one or more heat transfer elements for transferring the heat from the PTC element to the moving volume of air. Also, the device includes a control subassembly adapted for proportionate control of the fan motor based on a variable required heat output so that the rate of movement of the moving volume of air varies in proportion to changes in the required heat output.

In yet another of its aspects, the invention provides an electric heating device including a fan for moving a volume of air at a rate substantially corresponding to a speed of rotation of the fan, and a fan motor for rotating the fan over a range of speeds. The device also includes a circuit having one or more heating resistors for generating heat and one or more PTC elements electrically connected in series with the heating resistor for generating heat and for controlling current flowing through the circuit. Also, the device includes one or more heat transfer elements for transferring the heat from the heating resistor and the PTC element to the moving volume of air. In addition, the device has a control subassembly adapted for proportionate control of the fan motor based on a variable required heat output so that the rate of movement of the moving volume of air varies in proportion to changes in the required heat output.

BRIEF DESCRIPTION OF THE DRAWINGS

The invention will be better understood with reference to the drawings, in which.

DETAILED DESCRIPTION

Figure 1:
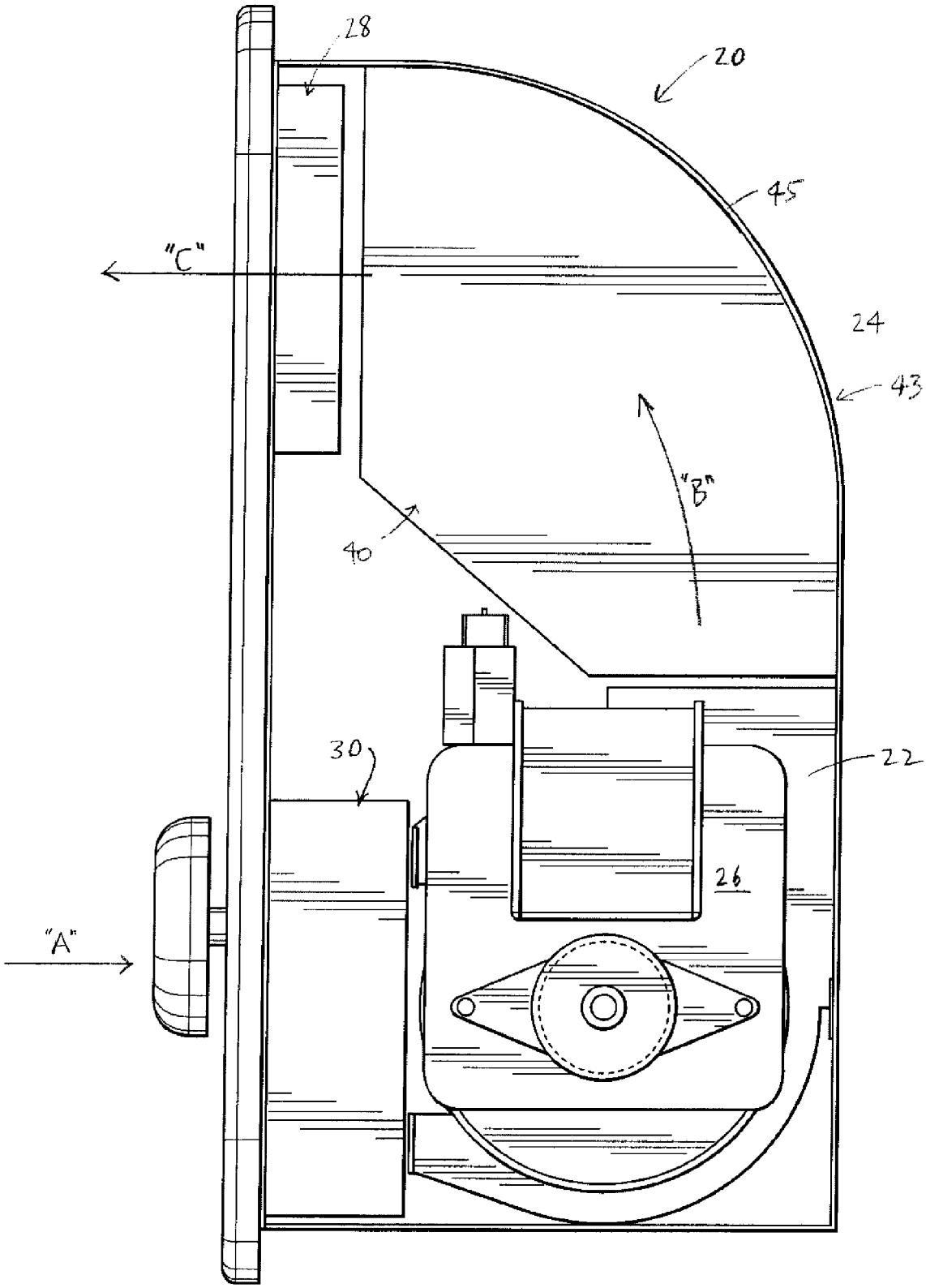
FIG. 1 is a cross-section of an embodiment of the electric air heating device of the invention.

Reference is first made to FIGS. 1-5 to describe an embodiment of an electric heating device in accordance with the invention indicated generally by the numeral 20. Preferably, the device 20 includes a fan 22 for moving a volume of air (indicated generally by the numeral 24) at a rate substantially corresponding to a speed of rotation of the fan 22, and a fan motor 26 for rotating the fan 22 over a predetermined range of speeds. The device 20 preferably also includes a heat generator 28 and a control subassembly 30. In one embodiment, the heat generator 28 preferably includes one or more PTC elements 32 (FIG. 4) for generating heat, and for transferring the heat to the moving volume of air. Preferably, the heat generator 28 also includes one or more heat transfer elements 34 (FIG. 4) providing relative large exposed surface areas, for effective heat transfer from the PTC elements 32 to the air flowing through the heat generator. The control subassembly 30 (FIG. 2) is adapted for proportionate control of the fan motor 26 based on a variable required heat output so that the rate of movement of the moving volume of air (i.e., moving through the heat generator 28) varies in proportion to changes in the required heat output, as will be described.

In one embodiment, the fan motor 26 is adapted to rotate the fan 22 over a range of speeds in proportion to a range of voltages of electricity supplied to the fan motor 26. The control subassembly 30 preferably includes a triac for altering voltages of electricity supplied to the motor 26 in proportion to variations in measured differences between ambient temperature and a preselected set temperature. The measured differences are determined by any suitable temperature sensor.

The control subassembly 30 preferably is adapted for proportionate control of the fan motor 26 based on measured differences between ambient temperature and a preselected set temperature. Preferably, the proportionate control is effected via a closed loop control system, i.e., a control system in which feedback is provided to the system which determines whether the fan motor is activated. The feedback preferably is provided any suitable ambient temperature-sensing means. For example, a suitable thermostat (e.g., including a thermistor for sensing ambient temperature) could be used to provide feedback. Because such feedback-providing devices and closed loop control systems generally are well-known in the art, further description thereof is not needed.

Figure 2:
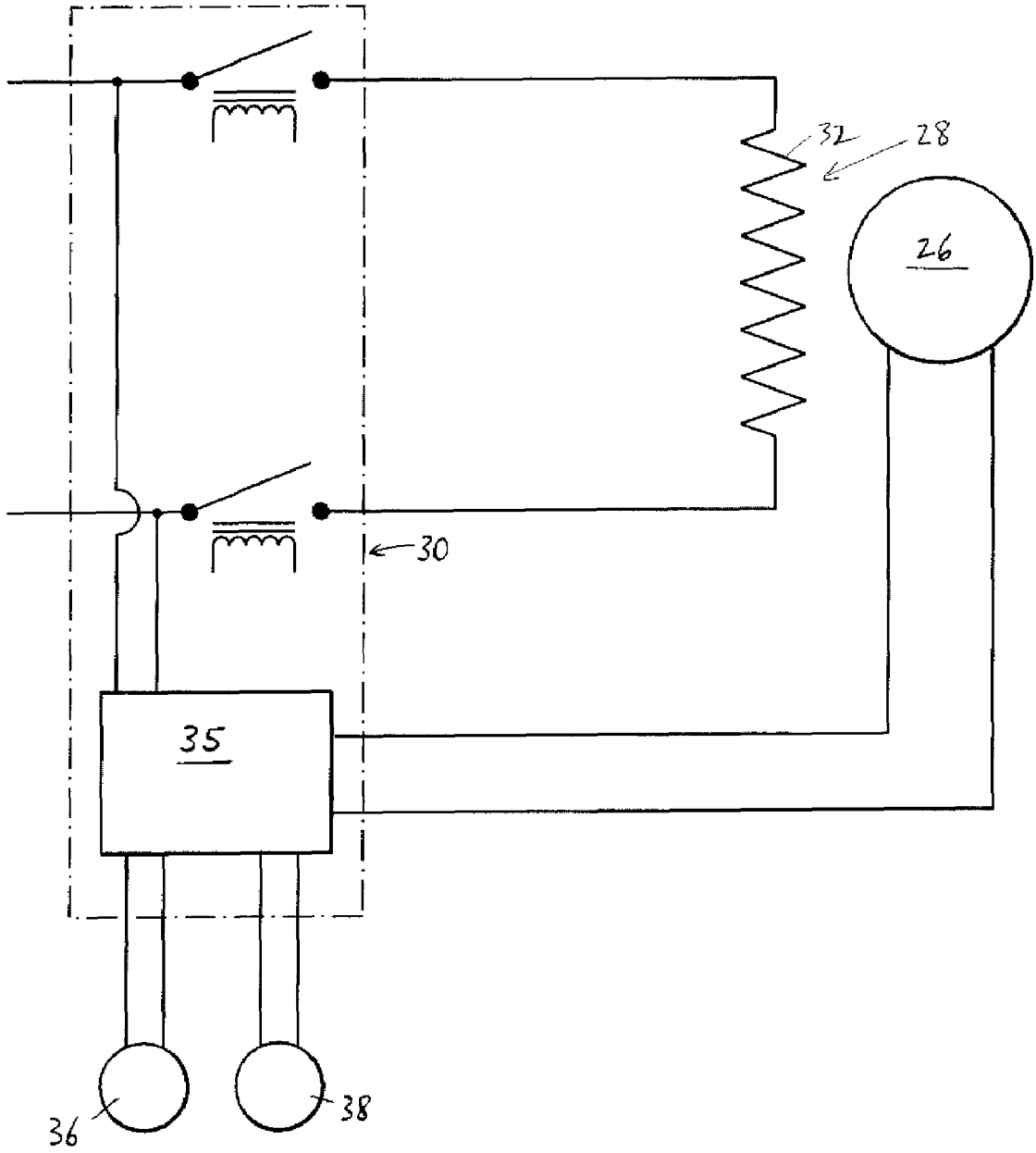
FIG. 2 is a schematic circuit diagram of an embodiment of an electric circuit for the heating device of FIG. 1.

As shown in FIG. 2, the heating device 20 preferably includes a circuit 35 to which the control subassembly 30 is operatively connected, for controlling the fan motor 26 based on settings input by a user via a control device 36, and also based on input from a thermistor 38. The control device 36 permits control of the set temperature, which is compared to information about ambient temperature provided by the thermistor 38. The control circuit 30 controls the speed of the motor 26 based on differences between the set temperature and ambient temperature. As noted above, the control circuit 30 preferably controls the speed of the motor 26 by causing the triac included therein to vary the voltage of the electricity supplied to the motor 26 based on differences between the set temperature and the ambient temperature.

Figure 3:
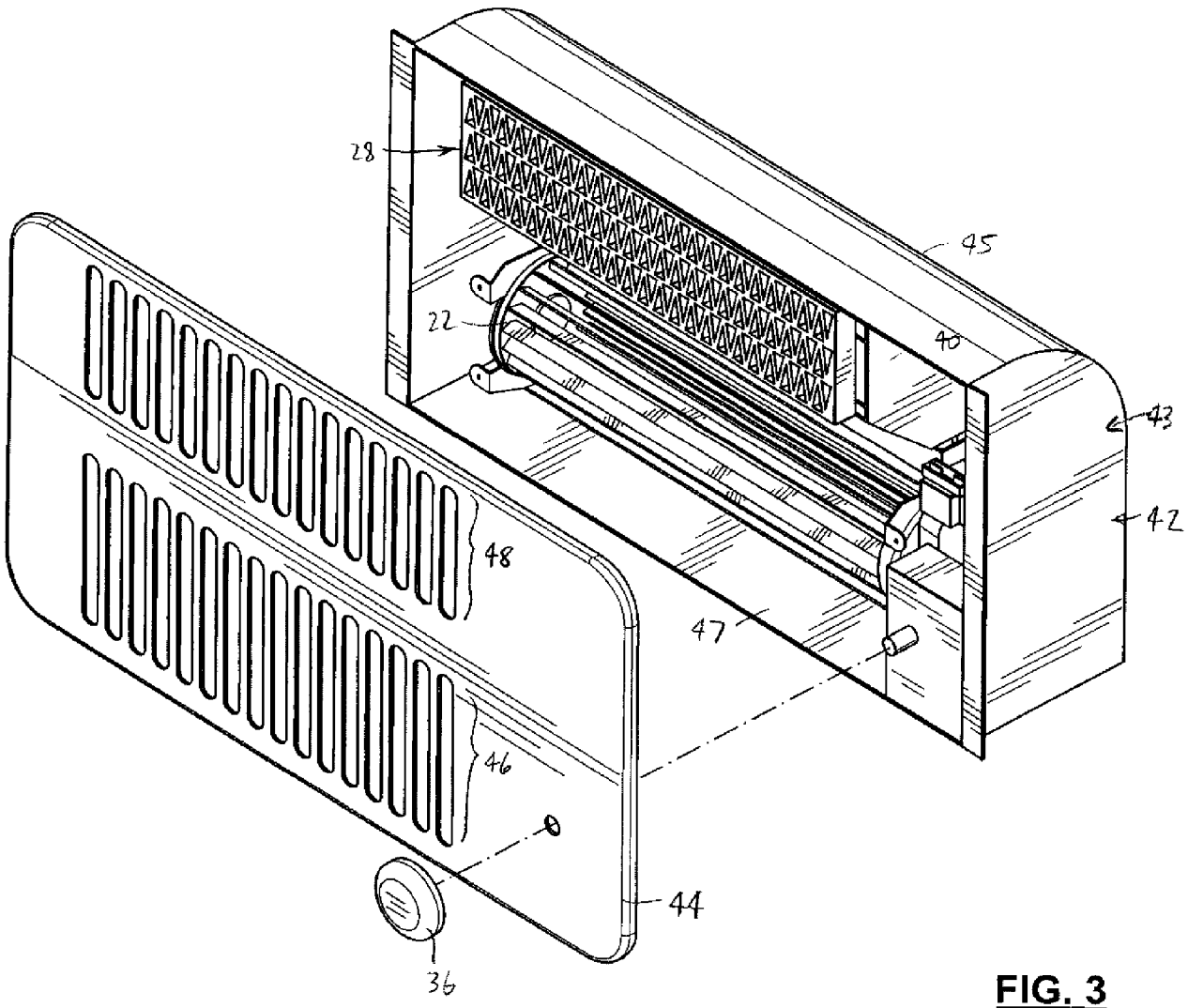
FIG. 3 is an exploded isometric view of the heating device of FIG. 1, drawn at a smaller scale, showing a grille removed from a housing body.
Figure 4:
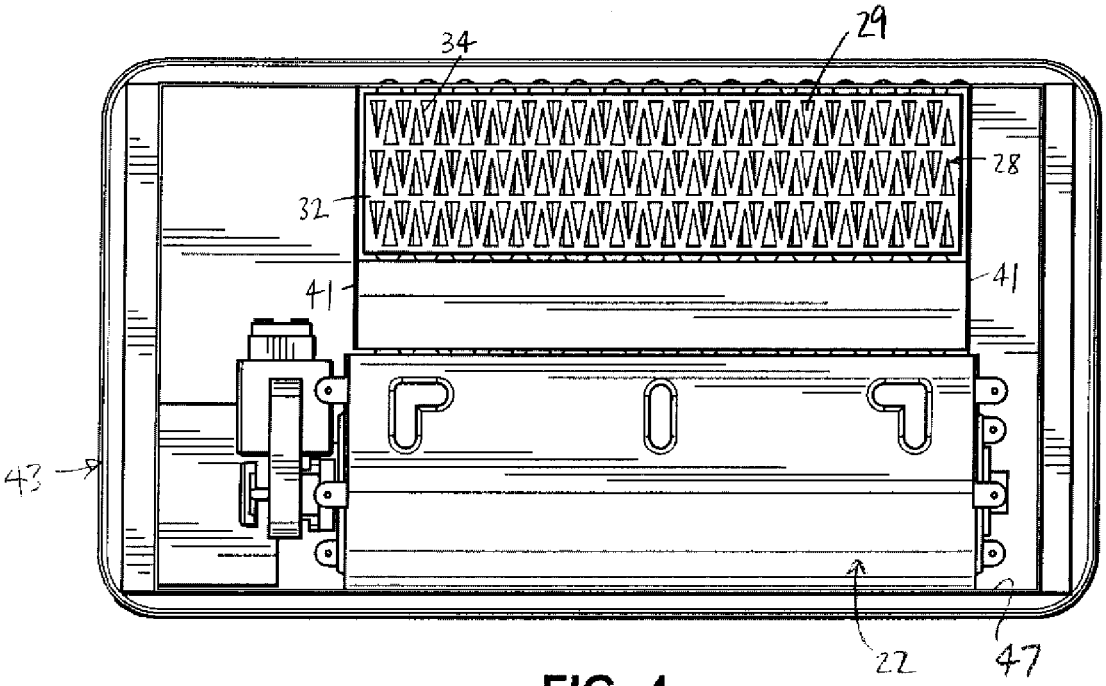
FIG. 4 is a rear view of the device of FIG. 1 with part of the housing body removed.
Figure 5:
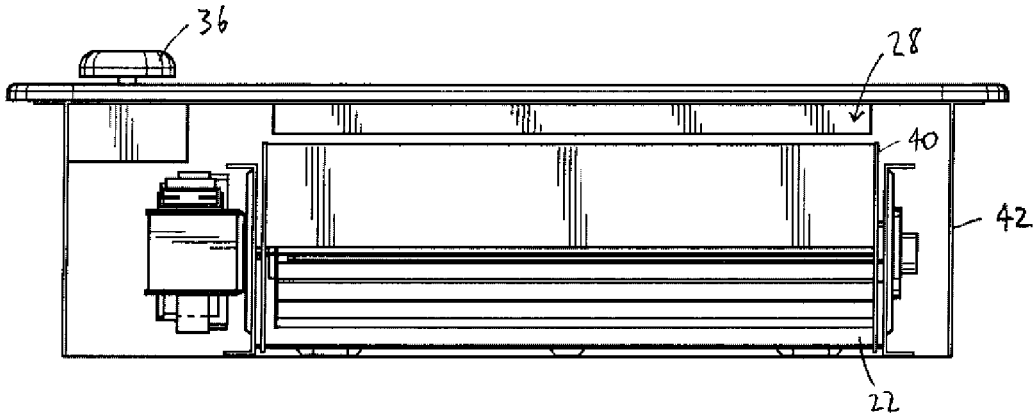
FIG. 5 is a top view of the device of FIG. 1 with a portion of the housing body removed.

As shown in FIGS. 3-5, the volume of moving air preferably is directed to the heat generator 28 by a channelling device 40. The channelling device 40 preferably is positioned in a housing body 42 in a housing subassembly 43. The housing subassembly 43 is made of any suitable material and preferably includes a grille 44 with an inlet portion 46 and an outlet portion 48. The channelling device 40 preferably includes two substantially parallel side portions 41 (FIG. 4) generally extending from the fan 22 to the heat generator 28, and a floor portion 47. Preferably, the moving volume of air is generally defined by the space enclosed by the channelling device 40 and a curved portion 45 of the housing body 42 (FIG. 1). The channelling device 40 preferably is made of any suitable material, e.g., light sheet metal.

Accordingly, the moving volume of air preferably is directed through the heat generator 28 by the channelling device 40. The air thus directed passes through apertures 29 in the heat generator 28. As noted above, the heat generator 28 preferably includes PTC elements 32 which generate heat when current is passed therethrough, and heat transfer elements 34 configured for transfer of heat from the PTC elements to the air moving through the apertures 29. In one embodiment, the heat transfer elements 34 are integrally formed parts of the PTC elements 32, shaped as appropriate for optimal heat transfer characteristics. However, the heat transfer elements 34 may alternatively be formed of a suitable heat-conducting material and suitably connected to the PTC elements 32, as will be described.

In use, the fan 22 is mounted in a bottom area 50 of the housing 42. The fan 22 is configured to draw air into the housing 42 through the inlet portion 46, as indicated in FIG. 1 by arrow "A". Moving air is then directed by the fan 22 into the channelling device 40, as indicated by arrow "B". The channelling device 40 directs the moving air over (or through) the heat generator 28 and subsequently through the outlet portion 48 of the grille 44, as indicated by arrow "C". The positioning of the fan 22 below the heat generator 28, and also the positioning of the outlet portion 48 above the inlet portion 46, are important because they take advantage of the fact that a volume of warm air (i.e., relative to air thereby surrounding) rises.

The control subassembly 30 controls the fan motor 26 based on a required heat output. As noted above, the control subassembly 30 preferably includes a triac which is adapted to alter the voltage supplied to the fan motor in proportion to the measured differences between ambient temperature and the preselected set temperature. For instance, if the preselected set temperature is 20° C. and the ambient temperature is 18° C., the triac, which preferably is operatively connected to a thermistor, adjusts the voltage of the electricity supplied to the fan motor 26 accordingly. However, if the ambient temperature were, for example, 17° C., then proportionately more voltage would be applied to the fan motor 26. Increasing the voltage of the electricity supplied to the fan motor 26 results in a proportionate increase in the speed of rotation of the fan 22.

It will be understood that an increase in the speed of the fan 22, which results in a proportionate increase in the rate of movement of the moving air which moves over the heat generator, lowers the temperature of the PTC element. Lowering the temperature of the PTC element results in more current being allowed to pass through the PTC element (i.e., the heat generator).

Figure 7:
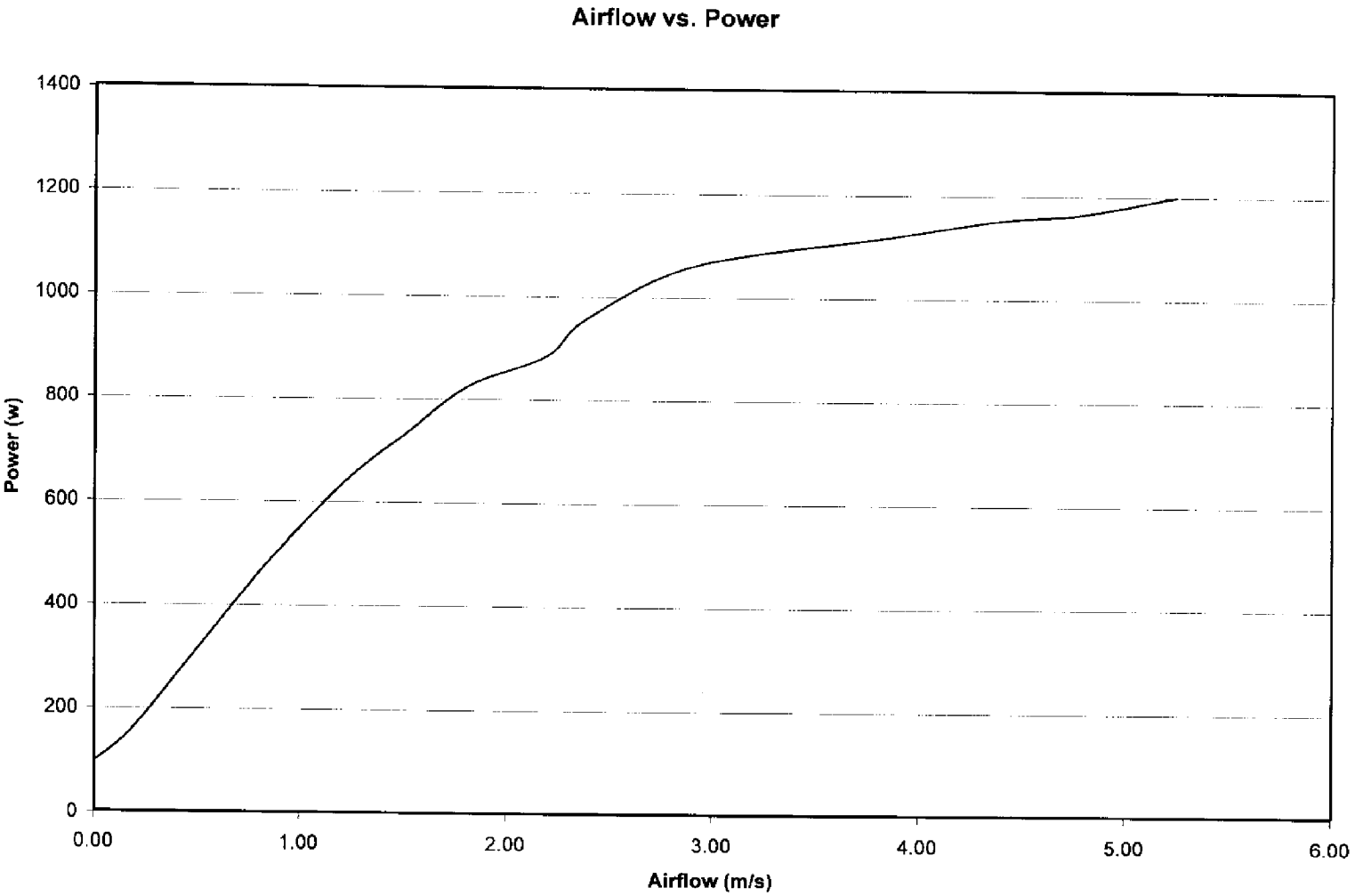
FIG. 7 is a graph of airflow versus power based on data resulting from testing of an embodiment of the device of FIG. 1.

As shown in FIG. 7, in one embodiment, the relationship between airflow and power is nearly linear, although it is not exactly linear. Instead, the curve on the graph of airflow versus power shows that although the power output is at approximately 800 watts with an airflow of approximately 1.7 m/sec., at approximately 1200 watts, the airflow is approximately 5.3 m/sec. The relatively flat profile of the curve shown in FIG. 7 indicates that the heater of the invention has a relatively high degree of operational stability, i.e., the relationship is almost linear.

Figure 6:
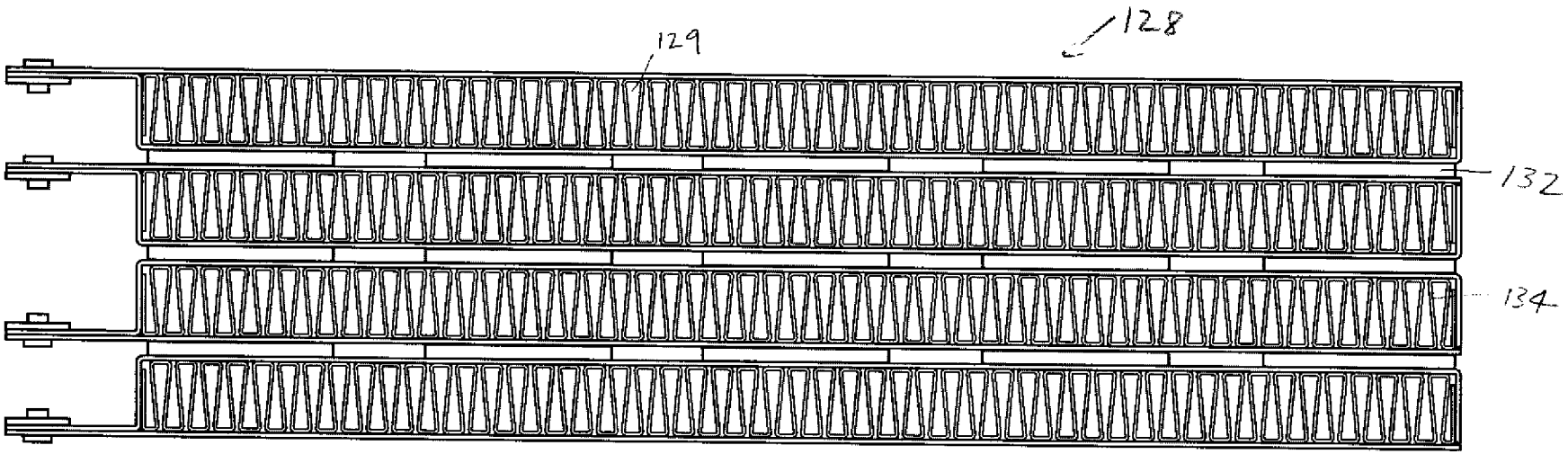
FIG. 6 is a front view of an embodiment of a heat generator of the invention, drawn at a larger scale.

Another embodiment of the invention is disclosed in FIG. 6, in which elements are numbered so as to correspond to like elements shown in FIGS. 1-5. In an embodiment 120 of the heating device, a heat generator 128 includes one or more PTC elements 132 for generating heat and one or more heat transfer elements 134 for transferring heat from the PTC elements 132 to the moving volume of air (FIG. 6).

Preferably, the heat transfer elements 134 are fins configured for optimal heat transfer characteristics (i.e., for transfer of heat from the elements 134 to the air moving past such elements), and suitably connected to the PTC elements (FIG. 6) for maximum heat transfer from the PTC elements 132 to the heat transfer elements 134. The heat transfer elements preferably are any suitable heat-conducting material, such as aluminium.

In one embodiment, the heat generator 128 is approximately 9.5 inches long, approximately 0.5 inch wide, and approximately 3.3 inches high. As can be seen in FIG. 6, the heat generator 128 preferably includes a plurality of apertures 129, to provide a relatively large surface area, for effective heat transfer. The solid volume is approximately 8.9 in.$^3$, and the surface area therein is approximately 187 in.$^2$.

Any element in a claim that does not explicitly state "means for" performing a specified function, or "step for" performing a specific function, is not to be interpreted as a "means" or "step" clause as specified in 35 U.S.C. § 112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. An electric heating device for heating air having an ambient temperature, the device comprising:

a fan for moving a volume of air at a rate substantially corresponding to a speed of rotation of the fan;

a fan motor for rotating the fan over a range of speeds;

a heat generator comprising at least one PTC element for generating heat, and for transferring said heat to said moving volume of air;

a control subassembly adapted for establishing a set temperature and comparing ambient temperature thereto to determine a variable heat output required to maintain the ambient temperature substantially at the set temperature; and the control subassembly being further adapted for control of the fan motor to cause the rate of movement of said moving volume of air to vary in proportion to changes in said required heat output.

2. An electric heating device according to claim 1 in which the fan motor is adapted to rotate the fan over a range of speeds in proportion to a range of voltages of electricity supplied to the fan motor.

3. An electric heating device according to claim 2 in which the control subassembly comprises a triac for altering said voltage of said electricity supplied to the fan motor in proportion to measured differences between ambient temperature and a preselected set temperature.

4. An electric heating device according to claim 1 in which said volume of moving air is directed to the heat generator by a channelling device.

5. An electric heating according to claim 1 additionally comprising a housing which at least partially defines said volume of air.

6. A method of heating air having an ambient temperature, said method comprising:

(a) using a fan motor to rotate a fan, to move a volume of air at a rate substantially corresponding to a speed of rotation of the fan;

(b) generating heat via a heat generator comprising at least one PTC element;

(c) directing said volume of air through the heat generator;

(d) transferring at least a portion of said heat to said moving volume of air via heat transfer elements in the heat generator;

(e) establishing a set temperature;

(f) measuring the ambient temperature;

(g) comparing the ambient temperature and the set temperature to determine a variable heat output required to maintain the ambient temperature substantially at the set temperature; and (h) controlling the fan motor to cause the rate of movement of said moving volume of air to vary in proportion to changes in said required heat output.

7. An electric heating device for heating air having an ambient temperature, the device comprising:

a fan for moving a volume of air at a rate substantially corresponding to a speed of rotation of the fan;

an electric fan motor for rotating the fan over a range of speeds;

a heat generator comprising:

at least one PTC element for generating heat;

at least one heat transfer element for transferring said heat from said at least one PTC element to said moving volume of air;

a control subassembly adapted for establishing a set temperature and comparing the ambient temperature thereto to determine a variable heat output required to maintain the ambient temperature substantially at the set temperature; and the control subassembly being further adapted for control of the fan motor to cause the rate of movement of said moving volume of air to vary in proportion to changes in said required heat output.

8. An electric heating device according to claim 7 in which the fan motor is adapted to rotate the fan over a range of speeds in proportion to a range of voltages of electricity supplied to the fan motor.

9. An electric heating device according to claim 8 in which the control subassembly comprises a triac for altering said voltage of said electricity supplied to the fan motor in proportion to measured differences between ambient temperature and a preselected set temperature.

10. An electric heating device according to claim 7 in which said volume of moving air is directed to the heat generator by a channelling device.

11. An electric heating device according to claim 7 additionally comprising a housing which at least partially defines said volume of air.

12. An electric heating device for heating air having an ambient temperature, the device comprising:

a fan for moving a volume of air at a rate substantially corresponding to a speed of rotation of the fan;

a fan motor for rotating the fan over a range of speeds;

a circuit comprising:

at least one heating resistor for generating heat;

at least one PTC element electrically connected in series with said at least one heating resistor for generating heat and for controlling current flowing though the circuit, at least one heat transfer element for transferring said heat from said at least one heating resistor and said at least one PTC element to said moving volume of air;

a control subassembly adapted for establishing a set temperature and comparing the ambient temperature thereto to determine a variable heat output required to maintain the ambient temperature substantially at the set temperature; and the control subassembly being further adapted for proportionate control of the fan motor to cause the rate of movement of said moving volume of air to vary in proportion to changes in said required heat output.

13. An electric heating device according to claim 12 in which the fan motor is adapted to rotate the fan over a range of speeds in proportion to a range of voltages of electricity supplied to the fan motor.

14. An electric heating device according to claim 13 in which the control subassembly comprises a triac for altering said voltage of said electricity supplied to the fan motor in proportion to measured differences between ambient temperature and a preselected set temperature.

15. An electric heating device according to claim 12 in which said volume of moving air is directed to the heat generator by a channelling device.

16. An electric heating device according to claim 12 additionally comprising a housing which at least partially defines said volume of air.

17. An electric heating device according to claim 16 in which the fan is positioned substantially below the heat generator, for facilitating movement of said volume of air from the fan to the heat generator.

18. An electric heating device according to claim 17 in which the housing comprises:

an inlet portion proximal to the fan through which air is drawn into the housing by the fan; and an outlet portion proximal to the heater through which air is pushed out of the housing by the fan, the inlet portion being positioned below the outlet portion.

* * * * *